United States Patent [19]

Johnson et al.

[11] 3,948,344

[45] Apr. 6, 1976

[54] LOW COST PLANAR AIR PALLET MATERIAL HANDLING SYSTEM

[76] Inventors: Raynor A. Johnson; William D. Fletcher, both of 904 Old Baltimore Pike, Newark, Del. 19711

[22] Filed: Oct. 3, 1974

[21] Appl. No.: 511,828

[52] U.S. Cl. ..... 180/124; 214/1 BE

[51] Int. Cl.[2] ..... B60V 1/04

[58] Field of Search ..... 180/116–125; 214/1 BE

[56] References Cited

UNITED STATES PATENTS

| | | | |
|---|---|---|---|
| 2,918,183 | 12/1959 | Petersen et al. | 180/125 |
| 3,251,431 | 5/1966 | Mackie | 180/124 |
| 3,261,177 | 7/1966 | Amann et al. | 180/125 X |
| 3,272,359 | 9/1966 | Thomas et al. | 214/1 BE X |
| 3,321,038 | 5/1967 | Mackie et al. | 180/124 |
| 3,760,899 | 9/1973 | Crossman | 180/125 |
| 3,826,329 | 7/1974 | Crimmins | 214/1 BE |
| 3,834.556 | 9/1974 | Crimmins | 214/1 BE |

*Primary Examiner*—M. H. Wood, Jr.
*Assistant Examiner*—Terrance L. Siemens
*Attorney, Agent, or Firm*—Sughrue, Rothwell, Mion, Zinn and Macpeak

[57] ABSTRACT

A planar air pallet supports a load for frictionless transport relative to an underlying fixed support surface. A single sheet of flexible plastic film may underlie a stack of cartons forming the load with the edges sheet heat shrunk about the stack of cartons. Small diameter perforations are provided at least within that portion of the sheet underlying the lowermost tier of cartons to form a plenum chamber, preferably through air dispersion members between the flexible sheet and the carton load. The perforations unrestrictedly open directly to said plenum chamber. Pillowing of the sheet portion of the plenum chamber is controlled to permit jacking of the load sufficiently for a combination of surface irregularity for both the load support surface and the backing surface. The air pallet may also comprise a flexible film bag, which carries internally a rigid sheet which may be the load to control pillowing and provide air dispersion.

18 Claims, 11 Drawing Figures

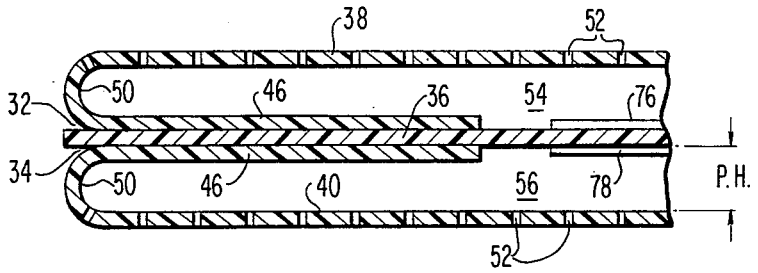
FIG. 3
FIG. 4
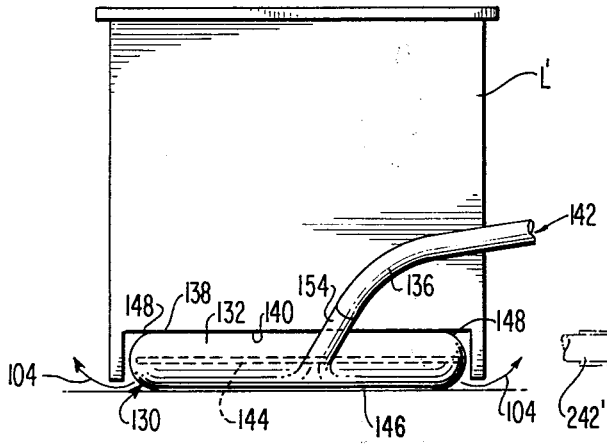
FIG. 5
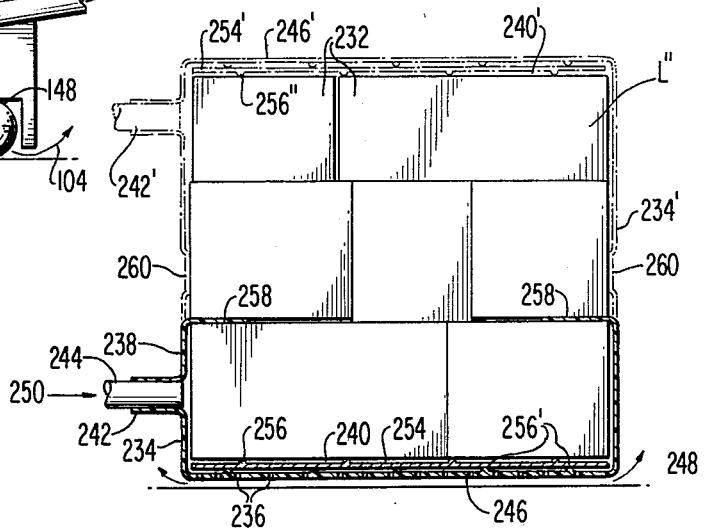
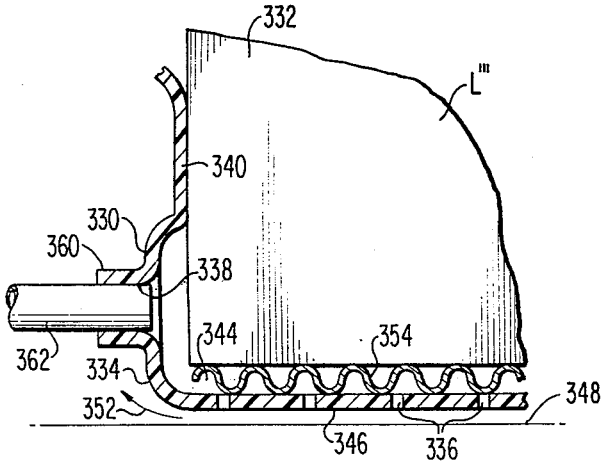
FIG. 6

FIG. 7
PRIOR ART
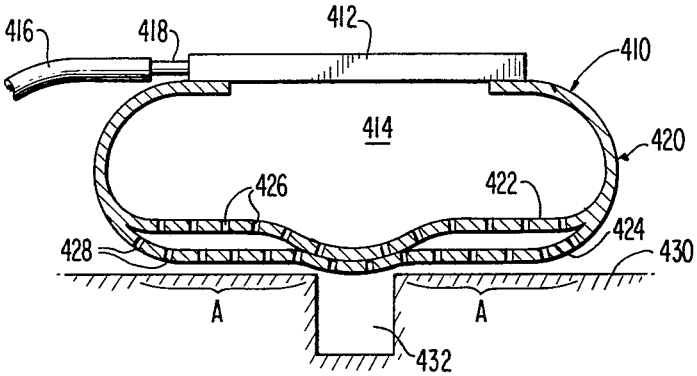
FIG. 8
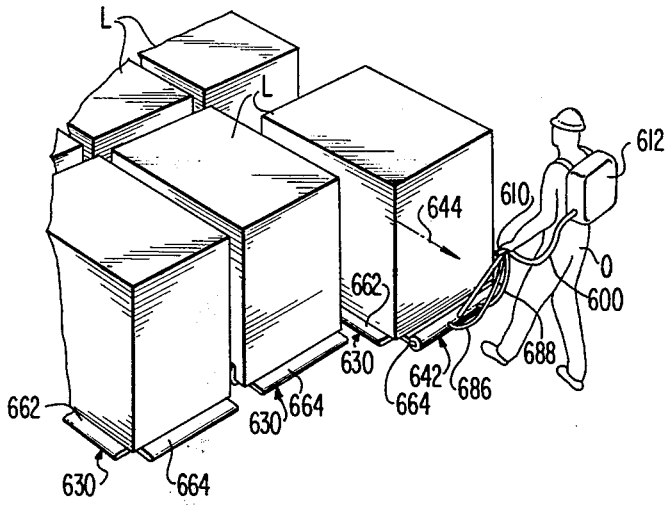
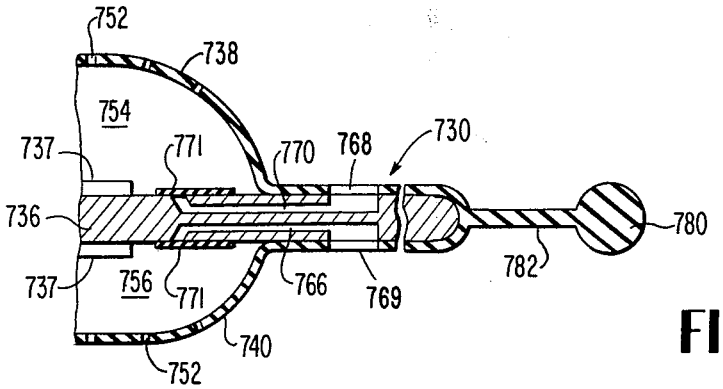
FIG. 11

LOW COST PLANAR AIR PALLET MATERIAL HANDLING SYSTEM

BACKGROUND OF THE INVENTION

1. FIELD OF THE INVENTION

This invention relates to the material handling field in general, and more particularly, to a planar, low cost air pallet material handling system permitting heavy loads to be transported with minimum frictional restraint.

2. DESCRIPTION OF THE PRIOR ART

To assist the storage and transport of material, common wooden pallets measuring 48 × 40 inches and weighing approximately 50 pounds support loads which are transported by conventional fork lift equipment, in which the fork lift operator moves the fork beneath the pallet and the overlying load and lifts the pallet and load sufficiently to permit by means of the fork lift vehicle, movement of the pallet and its load from location to location.

Wooden pallets last roughly three years, have sharp corners and after rough usage nails are exposed and broken boards which damage the loads carried thereby. The pallet itself is of a weight and configuration such that it is somewhat difficult for a single man to handle the same. Further, with the pallet being nonflexible in size, space for storage and transport of the load and the pallet is determined by the pallet size, rather than load size or available space in the transport vehicle. Further, in the trucking industry, each trucker is responsible to remove his load from the truck to the customer's tail gate or from the customer's pick up and customer's tail gate, and place it on the particular truck. Of necessity, a trucker's helper is required on all trucks since it is impossible for the trucker alone to readily move the goods to and from the truck. Further, the common fork lift is generally too heavy to move into the tractor trailer itself since it breaks through the floor of the same and therefore in many cases hand loading and unloading operations are required in which the trucker or his helper is required to employ a hand dolly. Even where the load may be retained on the pallet and a fork lift truck or the like moves the pallet and the load into the tractor trailer or the box car for rail transportation, the pallets weight of 50 pounds, takes up a good portion of the load, and additionally, each takes a portion of the space permitted by occupancy of the load, greatly increasing the cost of transporting of material. While pallets are uniform in nature, and cost approximately $5.00 new, since the pallets are shipped from location to location and generally exchanged, one shipper who ships on new pallets may recover in their place used pallets which are close to the end of their useful life.

In spite of the difficulties in employing wooden pallets, transport systems today are generalized in terms of the use of the pallet. For instance, in 1970, more than 100,000,000 wooden pallets were sold, having a general lift expectancy of three years, in spite of the deficiencies of the same as outlined above.

One of the additional disadvantages of the wooden pallet material handling system, is the fact that, in every case, the load including the pallet supporting the same must be raised above the floor prior to further lateral movement by the transport vehicle from position to position.

In an attempt to reduce the work necessary in moving palletized loads, pallets have been modified to incorporate ground effect machines, whereby, the application of superatmospheric air in the form of an air bearing or film between the bottom of the pallet and the floor supporting the same, has practically eliminated the friction between the pallet, and the underlying floor. This permits the load to be moved laterally along the floor or other support surface on an air film in a relatively frictionless manner. However, known air cushion pallets have necessarily required relatively bulky and heavy means for supplying the pressurized air and, in which case, the decrease in the frictional restraint by the presence of the air film has been more than balanced by the complexity and added load of the pressurized air generating equipment. Further, in the known air cushion pallets, the air cushion established by the pressurized air between the bottom surface of the pallet and the underlying support such as the floor may be maintained only where there is continuity in the floor surface itself and the presence of cracks, or irregularities in the floor result in the loss of the air cushion and the elimination of the frictional support.

In the air cushion field, there has recently developed an air valve in which air flow is kept to a minimum and in which case, the self valving arrangement permits localized termination of the air cushion or bearing surface at irregularities or cracks within the surface over which the air cushion is moving such that the air cushion may readily ride across such cracks without appreciable increase in resistance to and without appreciable change in the air cushion of the same.

Reference to FIG. 7 illustrates an air cushion of the prior art which incorporates a self valving feature as an improvement over conventional air cushions. In this respect, the air cushion indicated generally at 410 is constituted by a rigid, rectangular manifold 412 which permits pressurized air or the like to enter a plenum chamber 414 from a source of air pressure (not shown) which is coupled to the air cushion 410 by means of a flexible hose or the like as at 416, terminating at rigid nipple 418 constituting a flow passage to the manifold 412. Chamber 414 is further defined by the manifold 412, and a two layer flexible, composite wall 420, the bottom surface of which is constituted by an inner perforated wall 422 and an outer perforated wall 424, the perforations 426 of the inner wall being laterally offset with respect to the perforations 428 of the outer wall with the perforated walls 422 and 424 forming a plurality of check valves, which act to stop the loss of air from within the chamber 414 to the exterior surface of layer or wall 424, unless the plenum pressure within chamber 414 is substantially equal to the pressure outside of the outer fabric layer 424. This condition exists only when an air bearing is formed between the surface of the outer wall 424 and the underlying support, in this case, floor 430. When the device crosses a void such as a ditch 432 within floor 430, each sectional area of the multi-layer composite flexible wall 420 closes as the device proceeds across the ditch 432 for instance from left to right, due to the pressure differential that occurs between plenum 412 and the localized exterior as defined by the ditch 432. It is noted, however, that all areas which are not over the void or ditch 432 are supplying air to the air bearing indicated at A on each side of the ditch 432.

SUMMARY OF THE INVENTION

The present invention is directed to an improved flexible air pallet for the frictionless movement of a load supported thereon relative to a generally planar fixed support surface. The air pallet requires a rigid or flexible generally planar backing surface for carrying the load and with the load uniformly distributed over that surface. A flexible thin sheet directly underlies the backing surface and directly overlies the fixed support surface, with the portion facing the generally planar fixed support surface being perforated and wherein the thin sheet and the backing surface define a plenum chamber. Air dispersion means within the chamber insures air flow throughout the chamber and complete pressurization thereof. Means are provided for controlling pillowing of the chamber to permit the pallet to accommodate surface irregularities for both the load support and the backing surface without ballooning and the pallet includes air inlet means for permitting air under pressure to enter the chamber for discharge through the the perforations to jack the load and create and maintain an air film between the flexible sheet and the fixed support surface. The flexible thin sheet may underlie the load directly with the load taking the form of a rigid carton, the sheet having edges projecting beyond the sides of the carton, with the edges rising upwardly and being sealably coupled to the carton sidewalls above the bottom thereof. The edges of the thin flexible sheet may be bound to the sides of the carton and thus the bottom of the carton and the flexible thin sheet define the plenum chamber. The bottom surface of the carton may be ribbed with the gaps between the ribs forming the air dispersion means. A separate member may be interspersed between the bottom of the carton and the flexible thin sheet and may comprise the air dispersion means. This member may also take the form of a ribbed plate, a rigid open framework or it may comprise a corrugated sheet. The edges of the sheet or plate act in conjunction with the outer row of perforations to control pillowing of the chamber and to prevent ballooning and to permit the air pallet to accommodate surface irregularities of the backing surface or the load support surface.

In another form, the air pallet may comprise a flexible bag such as conventional flexible, thin, plastic garbage bag modified to the extent of having the planar side perforated which faces the fixed load support surface. The bag may have internally, a plate whose dimensions are slightly less than that of the flexible sheet material bag, and the open end of the bag which forms the air inlet means may be sealably wrapped about the discharge end of a vacuum cleaner wand. The bag may have opposed edges or corners of its upper surface clamped to the bottom of a desk or the like with the desk acting as the load and forming the planar backing surface. By fixing the bag to the bottom of the desk, pillowing of the chamber is controlled, and the bag is prevented from ballooning.

In another form, the air pallet comprises an imperforate center sheet and flexible, thin outer sheets sandwiching the center sheet and being edge sealed thereto, the surface area of the flexible thin outer sheet is slightly in excess to that of the center sheet to permit controlled pillowing. The center sheet is provided with air dispersion means on each side to insure air flow throughout the plenum chambers formed between the respective flexible thin sheets and the center sheet. The portions of the flexible thin sheets facing the load and the planar fixed support surface carry small diameter perforations and air inlet means are provided for both plenum chambers to permit air under pressure to enter the chambers for discharge through the perforations to create, in a selective manner, air films between the flexible sheet, the fixed support surface and the load.

Preferably, integral edge flaps are provided along given edges of the outer sheets and are turned back and tucked or sandwiched between the flexible thin outer sheets and the center sheet. In this case, the flexible thin sheets are edge sealed at their periphery to the center sheet except at those portions of the edges provided with the edge flaps. The edge flap performs a self-valving function to permit the insertion of an air nozzle therein, and seal the plenum chambers at that point about the inserted air supply nozzle if carried thereby such that the plenum chambers at the air inlets are sealed, regardless of whether the air inlets have an air nozzle inserted therein or are devoid of such air nozzles.

Preferably, two right angle edges of a rectangular planar air pallet carry air passages and preferably incorporate the integral edge flap as valve means leading to respective upper and lower plenum chambers. Clamps having pivotable jaws mechanically clamp the jaws to a given edge of the rectangular planar air pallet, and air passages within the clamp corresponding to the air passages within the edges of the planar air pallet permit delivery of air to selective chambers and permit pulling or pushing forces to be exerted on the planar air pallet directly through the clamp. Valve means, either carried by the air clamp or by the air pallet, may selectively direct air from a common source to the upper or lower chamber in a selective manner or to both chambers for controlled creation of air bearings to the upper and lower surfaces of the pallet. A low volume pressurized air source may comprise a back pack carried by the operator who pushes or pulls the load by means of a manually held handle or wand which is coupled by way of the clamp at its discharge end to the air pallet.

The clamp may carry an air blower within the handle powered by an electrical source or powered by a battery within the power pack. The clamp itself may be provided with an air bearing at its bottom surface to facilitate movement of the same. A flexible bead may project from the outer edge of the planar air pallet, permitting a tapered lower jaw of the clamp to slide under the air pallet with a longitudinal slot within the air clamp lower jaw receiving the bead, such that upon pivotable closure of the upper jaw onto the air pallet and sandwiching of the pallet between the upper and lower jaws, the edge of the planar air pallet is mechanically locked to prevent separation of the clamp from the air pallet except by release of the jaws.

A lift truck may be modified to include an extendable, rigid support which carries an air clamp for clamping a selected edge of the air pallet and means controlled by the vehicle permits the application of air from an air pressure source selectively to the upper and lower plenum chambers of a two chamber planar air pallet, for example.

BRIEF DESCRIPTION OF THE DRAWINGS

FIG. 3 is a sectional view of the air pallet of FIG. 1 taken about line 3—3 of FIG. 1.

FIG. 4 is an end view of yet another embodiment of the air pallet of the present invention employed in the transportation of a desk.

FIG. 5 is yet another embodiment of the air pallet of the present invention as applied to a multi-tier stack carton load.

FIG. 6 is an enlarged, sectional view of one portion of yet another embodiment of the air pallet of the present invention.

FIG. 7 is a sectional view of a prior art air cushion employing a low volume air valve.

FIG. 8 is a perspective view illustrating the manual use of the air pallet of FIG. 2 in material handling.

FIG. 11 is a sectional view of a portion of the air pallet of FIGS. 9 and 10.

DESCRIPTION OF THE PREFERRED EMBODIMENT

Figure 1:
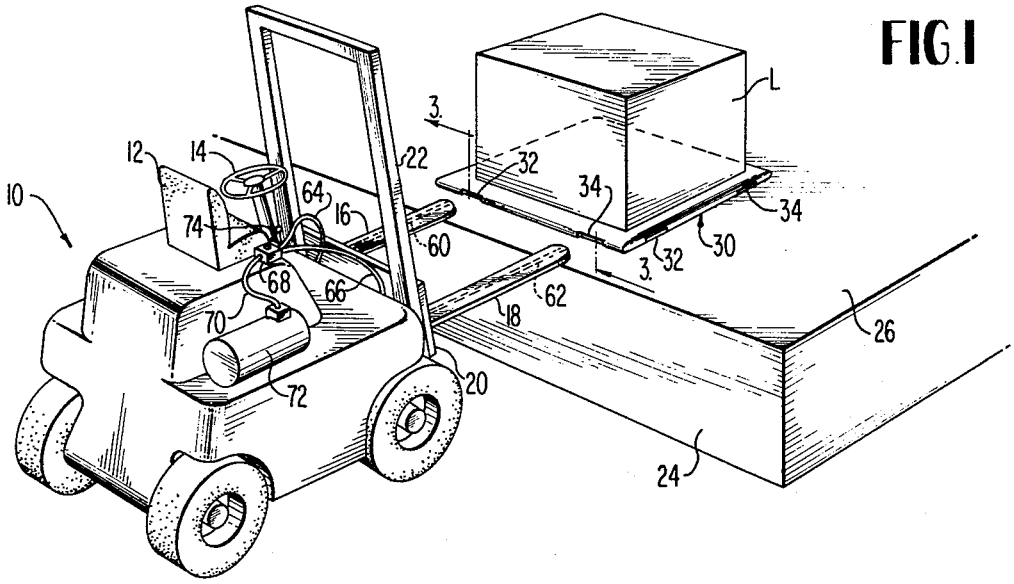
FIG. 1 is a perspective view of the improved, flexible thin sheet air pallet of the present invention in one form, as supplied by air under pressure from a modified fork lift truck.
Figure 2:
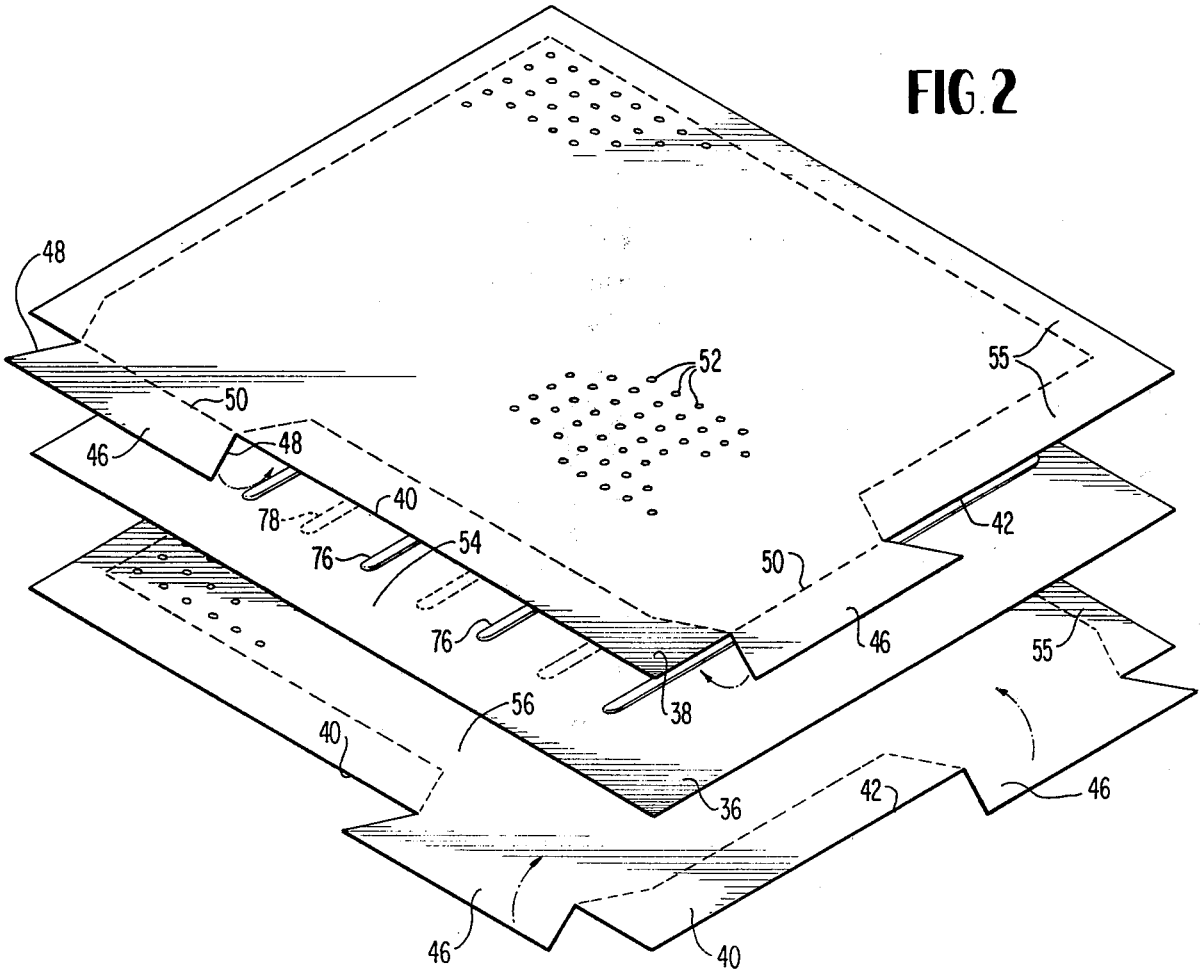
FIG. 2 is an exploded, perspective view of the air pallet of FIG. 1 showing the constructional details.

Referring to FIGS. 1–3 inclusive, one embodiment of the improved flexible sheet air pallet of the present invention is illustrated in conjunction with a modified fork lift truck or like vehicle illustrated at 10. The fork lift truck 10 in most respects is conventional in nature. That is, it is provided with a seat 12 upon which an operator (not shown) rides, the operator steering the truck by means of said steering wheel 14. Projecting forwardly from the vehicle 10 is a pair of forks 16 and 18 which extend generally horizontally from a vertical plate 20 to the rear of which is provided an open rectangular frame 22 which acts as a backing for the load supported on the forks 16 and 18 such that the sides of the load L facing the fork lift truck may rest against plate 20 and/or frame 22 as the case may be. The fork lift truck 10 is shown as facing a load platform 24 having horizontal fixed load support surface 26 and upon which rests one form of the flexible thin sheet air pallet 30 of the present invention. Supported in turn by air pallet 30 is load L which in this case takes the form of a rectangular block which may, for instance, comprise a cardboard carton. As seen in FIG. 1, the air pallet is shown as having left and right valved air inlets 32 and 34 along respective right angle intersecting edges of the rectangular, planar air pallet 30.

The make-up and construction of the air pallet in the form illustrated in FIG. 1 may be seen by further reference to FIGS. 2 and 3. The flexible thin sheet air pallet 30 comprises in this embodiment an imperforate center sheet 36 which is rectangular in form, and having, edge sealed to opposite sides thereof, outer flexible thin sheets 38 and 40 at the top and bottom, respectively. The sheets 38 and 40 are identical in all respects, with the exception that they are provided at intersecting right angle edges 40 and 42 with air inlet valve flaps 46 which are integral edge projections of the rectangular sheets and which flaps have outwardly flared side edges 48. The flaps 46 are folded at fold line 50 which corresponds to the edges 42 and 44, the flaps being turned internally between the outer sheets 38 and 40 and center sheet 36, that is, they are sandwiched between these sheets and center sheet 36. The periphery of the thin flexible outer sheets 38 and 40 are devoid of perforations while the interior carries preferably a regular pattern of small diameter holes or perforations 52 which perform the function of creating the air bearings when the plenum chambers 54 and 56 formed by the center sheet 36 and outer sheets 38 and 40, respectively, are subjected to fluid pressure. In this embodiment, and the other embodiments of the invention, the perforations unrestrictedly open directly to the plenum chamber partially formed by the perforated flexible sheets. Sheets 36, 38 and 40 may all be formed of identical material such as paper, closed cell foam, rubber, plastic film or sealed cloth. In the illustrated form, sheets 36, 38 and 40 comprise plastic film such as polyethylene or polypropylene film with the peripheries or edge portions 55 to the extent of the dotted lines being heat sealed, for instance, to the both sides of the center sheet 36 with the exception of those areas occupied by the inlet valve flaps 46. The resiliency and flexibility of the sheet material permits the bend lines 50 to act as hinges for the flaps such that the flaps become self sealing. This permits the introduction of a nozzle or other means for pressurization of chambers 54 and 56 to enter the throat defined by the non-sealed portions of the sheet edges and between the flaps 46 and the facing portion of the center sheet 36. In the illustrated embodiment of FIG. 1, the forks 16 and 18 or fork lift truck 10 are provided with air passages 60 and 62 which open at the outboard ends of the forks 16 and 18, and which are fluid connected by way of lines 64 and 66 respectively and control valve 66, common line 70, to a source of compressed air such as a combined compressor and air storage tank 72. The control valve 68 is provided with a valve actuator handle 74 which controls selectively the application or non-application of air under pressure to the chambers 54 and 56 by way of forks 16 and 18 or terminates the application of applied air pressure thereto.

In order to insure that the plenum chambers 54 and 56 will become pressurized, it is necessary to prevent the flexible sheets 38 and 40 from sealing tightly against the center sheet 36 by the weight of the load L. Air dispersion means in the form of projecting ribs 76 on the upper surface of the center sheet 36 and 78 on the lower surface, insure even when the air pallet is deflated, that there is some air gap between the outer and inner sheets such that upon insertion of the forks 16 and 18 (or their equivalent) into the valve inlets 32 and 34 of the air pallet 30, and the application of air pressure to passages 60 and 62, the pressurization of chambers 54 and 56 will occur. Upon removal of the fork lift, the flaps 46 being flexible simply move away from the surfaces of the center sheet 36 to permit the entry of the forks 16 and 18 and conform to the configuration of the work so that upon discharge of pressurized air into the chambers 54 and 56 the flaps 46 move into the sealing contact with the surfaces of the forks 16 and 18 and with the center sheet 36 so as to seal off the chambers 54 and 56 from the outside except through perforations 52. Thus, flaps 46 for the unused inlets 32 and 34 on edge 44 remain sealed. From the referenced prior art, and from the above description, the operation of the flexible simplifiied flexible thin sheet material air pallet of FIGS. 1-3 may be readily apparent. It is necessary to provide sufficient air to chamber 56, for instance, to lift the load L. In the illustrated embodiment of FIG. 1, the fork lift forks merely function to puncture the flap sealed chambers 54 and 56 and pressurization of respective chambers occurs by selective air pressure application to passages 60 and 62 within the forks 16 and 18. The ribs 76 and 78 function to provide the air dispersion necessary under load since the load would tend to flatten the flexible pallet. However, with the forks 16 and 18 stopping just short of ribs 76 and 78, air flow between the ribs adjacent the surface of the center sheet 36 inflate a given chamber or chambers under full load. Initially, upon the application of air pressure to the chamber 56, the load is jacked upwardly from platform 24 and the introduction of air at one end of the chamber permits full inflation of that chamber. Where sheet 36 may comprise a rigid sheet rather than a flexible sheet of the same material or of similar material to the outer sheets 38 and 40, air dispersion means may consist of fluid passages within the center sheet 36.

The air chamber 56 must hold enough pressure to overcome the weight of the load that is being lifted and transported and initially the air chamber's function is to first elevate the load as a jack or lifting device and subsequently, the creation of an air bearing between the perforated portion of the outer sheet 54 and surface 26 of the platform. Because of the thin flexible nature of the sheets 36, 38 and 40, control of pillowing is an important aspect of the present invention. The pressurization of chamber 56 not only acts to lift or jack the load L upwardly, but if the pressurization were to continue the tendency would be to lift the central perforated portion of the sheet 54 off the platform and permit the air to be expelled freely to the atmosphere without being controlled by a narrow air gap of a few mills which is essentially set up between the perforated lower sheet 40 and platform surface 26. In the embodiments of the invention to be described hereinafter, the effect of overinflation of the plenum chamber and the loss of capability as an air pallet may be more readily appreciated than in that of FIG. 1. However, if pillowing, that is, the controlled extent of jacking up of the load becomes excessive, in the embodiment of FIG. 3, for instance, the load L could topple to one side or the other off of the air pallet. In this illustrated embodiment of the invention, the extent of pillowing is determined by the excess in surface area of sheets 38 and 40 to that of center sheet 36, so that there is some vertical surface area to each of the sheets 38 and 40 under proper pressurization of chambers 54 and 56. Where the center sheet 36 takes the form of a rigid plate, the plate controls pillowing. However, alternate means may be employed by lamination of an additional member to center sheet 36 or to either of the outer sheets to control pillowing. The internal rib if made rigid or by addition of internal strips, lined diagonally from corner to corner or vertical from face to face may be employed to control the degree of pillowing. The load itself may act as the pillowing control means. In a simplified form, a rigid plate which acts as the immediate load support in conjunction with but a single flexible sheet may provide the pillowing control.

In the various embodiments of the present invention, the size of the blower, pressure capability of the blower, the valving or gating and the extent to which the air system is fixed or movable, all enter into the operability and effectiveness of the system. The extent of the initial jacking and the pillow height which is illustrated in FIG. 3 as that dimension PH between the bottom surface of center sheet 36 and the top surface of thin flexible sheet 40 will be determined by the depth of the surface irregularity of the surface upon which the load is being moved, for instance, the surface 26 of the loading platform. By application of valve control 74, air is built up for instance in plenum chamber 56 until a full pillow of a desired height is created that is needed for the movement of the load. The continued application of air, which is initially prevented from escaping out of the bottom perforated sheet 40, reaches the point where the pressure in excess of that necessary to lift the load causes a portion of the air to escape out of the perforated bottom sheet and between that bottom sheet and the fixed load support surface 26. The continued application of air under pressure is required to balance the loss of air as the load moves across the surface of the platform and further, additional air pressure is needed to correct for any loss of air through a depression or other surface discontinuity when encountered during pallet travel. These necessities may be readily apparent by reference to the prior art. Once the load reaches a desired position, the cessation of air flow to chamber 56 permits the pallet to settle down at its proper spot. By controlling the pillowing, this permits, along with the flexibility of at least the outer sheet or sheets, the pallet to conform to the surface irregularity whether such surface irregularity comprises a depression within or in fact a projection on the fixed load support surface 26 of the platform. It is intended that the air pallet 30 in the embodiment of FIG. 1 may be moved about the platform by a person carrying a portable source of fluid under pressure either by way of a powered air blower supplied by an electrical source such as a portable battery also carried by the operator. In such cases, the air blower which may be similar in form to and have the capability of a vacuum cleaner, may permit by way of a vacuum cleaner attachment such as wand whose discharge end may be inserted within a given valve inlet opening 32 and 34, the pressurization of either the upper or the lower plenum chamber or both in the manner of the referred to patent application.

It is important to note, that fluid passages must be provided beneath the loads to permit the air to get in and under the load to start jacking of the load upward. These means may also perform the additional function of controlling the pillowing and preventing the ballooning of the air pallet to the extent that the load topples off of the pallet in an attempt to create a fluid bearing between the bottom surface of the air pallet and the fixed load support surface or platform. It is obvious that if the pillow is approximately four inches deep, the load may be moved over a surface having higher irregularity than one where the pillow is only one-quarter inch deep. The fluid bearing must be maintained at a high energy level so that it can pass over a curb or minor surface obstructions. The employment of an interior sheet, cross bands between the outer sheets and the center sheet (in this embodiment) or vertical ties may be employed to control the degree of pillowing at all times. Thus, in this case, in the absence of a predetermined amount of surface variance between the center sheet and the outer sheet, the pillowing will not be determined by the extent of that peripheral enlargement but by the extent of the vertical restraints. Further, internal plates or the employment of a rigid center sheet permits the center sheet not only to act as an anti-balloon or pillowing control but also as a means to insure air dispersion throughout the chamber. For instance, if the center sheet comprises a rigid board or plate that is one inch smaller than either of the outer sheets, uniformly about its periphery, the result would be roughly a two inch pillow for the air pallet. The smaller the pillow, the more stable the whole package is, thus, it is important that the pillow be sized to meet the operation of the material handling system.

There is no true criticality in terms of the parameters making the air pallet operational. The total lift is equal to the effective air pressure times the area in contact with the floor, the size and number of holes or perforations should be determined by the area equal or less than the air supply area, the weight of the load divided by the area gives the minimum pressure needed for initial lift and the excess pressure over minimum necessary to lift will regulate the amount of unsupported floor area the pallet can cross. If these are exceeded, the pallet bottoms and the load is no longer frictionlessly transported. This is just a straight forward relationship of physical constants. Preferably, the system should operate such that there is always an excess in volume of air being supplied to that needed to maintain an effective air film between the air pallet and the load support surface.

Referring to FIG. 4, an alternate embodiment of the invention is shown in a most simplified form. In this arrangement, the air pallet 130 comprises essentially an open ended plastic flexible thin plastic film bag, formed of polypropylene or polyvinyl chloride film. The air bag 132 may be in form, size and configuration essentially identical to conventional plastic bags which are employed as "garbage bags" and sold commercially in food chain stores. In this respect, bag 132 is essentially rectangular in form and has its open end 154 sealably wrapped about the discharge end of a vacuum cleaner wand or like attachment 136 which is coupled at its opposite end (not shown) to the pressure discharge side of a vacuum cleaner or the like. The operator may hand wrap the bag end 134 about the wand and hold it in place. A rubber band could suffice. The load L′ in this case consists essentially of a rectangular desk or other article of furniture beneath which the air bag 132 is provided such that its upper surface 138 rests against the bottom surface 140 of the desk, while the opposite or bottom side 146 of the bag faces and rests upon load support surface 126 which may comprise the floor of an office building or the like. The side 146 of the bag which is perforated, performs the function of creating an air bearing which is seen in terms of the arrows 104 showing the escape of the air from beneath the bag and outside of the bag periphery upon the application of air pressure through wand 136 as indicated by arrow 142. The bottom surface 140 of the article of furniture such as desk L′ defines the rigid, generally planar backing surface for carrying the load by the air pallet 130. However, in order to insure that the air bag 132 is properly inflated to jack or raise the load L′ above the surface 126 of the floor, air dispersion means are provided within the interior of the bag in the form of a rectangular rigid plate 144 which may suitably carry on the upper or lower surface or both, ribs much in the manner of ribs 76 and 78 of the embodiment of FIG. 3. This arrangement may be even more greatly simplified by the elimination of plate 144 since the air bag 132 fits the space between the bottom 140 of the desk and the floor 126, and between the legs 146. In this case, it is necessary only that the bag be attached either along opposed side edges as at 148, or the respective corners of the bag to the corners of the bottom 140 of the desk so as to control the pillowing and to prevent ballooning of the air bag 132. If no such control means were provided, the application of high pressure as shown by arrow 142 would simply cause the bag to form a spheroid in which case most of the perforations on the bottom surface 146 of the bag would be open to the atmosphere and not face the floor 126. In this case, the bottom 140 of the desk acts both as the pillow control means and as the planar backing surface for load L′. In the sense that all fluid or air bearings act in a self valving nature, it may be appreciated that with a relatively low pressure supply, the initial pressurization of the plenum chamber defined by bag 132 and the creation of an air bearing of perhaps one mill thickness may readily occur, but by increased pressurization and an increase in the air escape path between the perforated bottom 146 of the bag and the floor 126, and an increase of the gap therebetween to perhaps three mills in thickness results in three times the venting area with the result of a relatively small movement and thus the weight of the load and the flow rate and thus the pressurization of bag 132 acts to balance out and maintain the balance and regulation of the system regardless of the weight of load L′. With a variable speed blower or other source for air flow 142 by variation in the speed, ready control over the power requirements for the air bag 132 is achieved.

Instead of plate 144 acting to define the air dispersion means as well as the pillowing control means for the air bag, and instead of having air bag 132 support an external load L′, the load may in fact be internal of the bag and take the form of a combined air dispersion and pillow control means such as plate 144 and, in which case, attachment of wand 136 to inlet 154 of the bag would permit pressurization of the bag and the creation of a plenum chamber between the internal load and the bottom wall 146 of the bag for escape through the perforations. By manipulation of the wand 136, either by pulling or pushing a load such as desk L′ is moved to the right or left or forward and backward as the case may be.

Referring next to FIG. 5, it is seen that a further embodiment of the simplified air pallet of the present invention takes the form, in another simplified case, of a single flexible thin sheet underlying the load L″ consisting in this case of three tiers of boxes or cartons 232 comprising an upper tier, an intermediate tier and a lower tier. The cartons form an essentially rectangular stack with the adjacent sidewalls for respective cartons of respective tiers being laterally offset so that the vertical air passages created by the sidewalls of adjacent cartons are essentially sealed by the overlying and underlying cartons forming the stack. Further, the load L″ has a certain weight such that the upper cartons press upon the lower cartons by gravity. This aids in the completion of an improved air pallet which requires but a single flexible thin sheet as the main constituent thereof. In this respect, sheet 234, which may be rectangular in form, has a surface area somewhat in excess of the surface area defined by the cartons of any one of the tiers (the horizontal surface area for all tiers being equal in this particular case). The bottom and central surface portion of sheet 234 is perforated as at 236 in similar fashion to the embodiment to the outer sheets of the embodiment of FIG. 1. The vertical sidewalls or peripheral edge portions 238 of the sheet 234 are imperforate and their ends are sandwiched between cartons or boxes of the lower tier and the intermediate tier such that a sealed plenum chamber 240 is created between the bottommost tier of cartons and sheet 234. Preferably, one of the sidewalls 238 is provided with an air inlet 242 which sealably receives the discharge end of a wand 244 connected to a positive pressure blower (not shown) as provided by a conventional vacuum cleaner or the like.

Thus, chamber 240 is pressurized to the extent necessary to lift the load L'' and to create an air bearing between the perforated bottom portion 246 of sheet 234 and an underlying fixed support surface 245. The air under pressure is shown entering inlet 242 by way of arrow 250 and escaping in a controlled manner between the narrow gap' formed by the air bearing between the fixed support surface 248 and the bottom wall portion 246 of the single flexible thin sheet 234.

While the cartons or boxes 232 themselves may be provided with ribs or other means to insure the creation of an air pocket between the bottom of the cartons of the lowermost tier and the flexible thin sheet 234, in the illustrated embodiment of FIG. 6, a plate 254 having ribs 256 at least on one side is positioned between the bottom portion 246 of the flexible thin sheet 234 and the cartons of the lowermost tier. Further, ribs 256' are shown as integral with and on the inner surface of the flexible thin sheet 234, which ribs, in the absence of plate 254, may act as the air dispersion means to insure pressurization of chamber 240 and the creation of the air bearing. In the manner of the prior discussed embodiments, the cartons function to define the rigid generally planar backing surface for carrying the load (carton contents) of the lowermost tier of cartons and those of the intermediate and upper tiers. Further, the cartons of the lowermost tier perform the function of controlling pillowing of chamber 240 along with the fact that the cartons of the intermediate and upper tiers sandwich the edges 258 of the sheet 234 to maintain the seal and prevent slippage of the sheet.

With the tiers having the cartons laterally offset and the flexible perforated sheet being sandwiched at its edges between the bottom and intermediate tier of cartons and by the inclusion of a spacer plate 254, beneath the cartons of the lowermost tier, there is created a self-contained mobile unit. Admittedly, some air escapes through the adjacent sides of the upper layers or tiers of boxes or cartons, but this may be considerably reduced by simply gluing those boxes together as is normally done in many unit load constructions. With a normal air supply as at 250, the loss between the cartons can be tolerated since it may be appreciated that the complete bottom surface 246 of sheet 234 is perforated to form a leak. The pressures in the chambers are relatively low and with small pressure a certain amount of additional leakage may be tolerated without deteriorating the air bearing.

With further reference to FIG. 5, there is shown in dotted lines the extension of the single thin flexible sheet 234 as at 234' which completely envelops the stack of carton 232 and which is preferably heat shrunk in a circumferential band as at 260 to seal the sheet 234 closely about the stacked carton load and to essentially seal in a modified form the lower plenum chamber 240 from the upper plenum chamber 240' which is created between the topmost tier of cartons and the top portion 246' of sheet 234. This top portion is perforated in the same manner as the bottom portion 246, and an upper plate 254' having ribs 256'' forms a mirror image of the bottom air pallet. In this modified form, flaps 258 are eliminated, and a second air supply 250' supplied to the upper plenum chamber 240' via air inlet 242' permits the creation of an air bearing above the load and between that load and an overlying load (not shown) This embodiment of the invention in modified form is intended to show the manner in which multiple air bearings may be provided in a simplified manner with respect to particular surface portions of a load which is sealably protected from the atmosphere by the very flexible film or sheet material which advantageously provides the make-up of the air pallet. While only a circumferential band 260 is shown as being heat shrunk, a greater portion or all of the flexible sheet or film material 234 may be heat shrunk. Further, while preferably the bottom and top layers of such material relative to the load should be loose material to provide maximum controlled pillowing to accommodate surface irregularities and permit sufficient jacking of the load to allow the load and combined pallet to move across an irregular fixed load support surface. It is envisioned for some heat shrunk packages that the complete film is heat shrunk, and in which case the perforated portion or portions would be relatively taut and stretched over the air dispersion means such as plate 254. It is important that the air inlets as at 242 and 242' be positioned such that air may enter the plenum chamber and be distributed throughout the same without obstruction. Particularly, this is important where the major portion or the complete portion of the flexible film material is heat shrunk in creating a package load and air pallet combination. It is further envisioned that an air pallet such as pallet 30 in FIG. 1 may be heat shrunk to load L by heat shrink material to the five sides of the rectangular load L exclusive of the bottom, beneath which lies air pallet 30. In such case, the enveloping sheet material would be sealed to the peripheral edge of the air pallet 30 without disturbing the means for selectively pressurizing the chamber of the planar air pallet to the paired valve inlets 32 and 34.

Referring to FIG. 6, an alternate embodiment of the invention comprises a modification of the arrangement of FIG. 5. In this case, a load L''' is provided with an air pallet 330 which essentially takes the form of a single flexible thin sheet 334, the load L''' comprising for instance a carton, and wherein sheet 334 may consist of a polypropylene plastic film which includes within that portion surrounding the perforated center portion 346, such as the vertical sidewall 338, a heat shrinkable section 340. The portion which comprises a band about carton 332 is heat shrunk in sealed contact with the periphery of carton 332. Thus, the heat shrunk portion 340 comprises a band completely about carton 332 and sealingly forming a plenum chamber 344 with the exception of perforations 336 within the bottom portion 346 of the thin flexible sheet 334. In order to insure proper pressurization at all points along the bottom of cartons 332, the cartons may rest upon a corrugated sheet 354 which is preferably rigid and acts as the air dispersion means within chamber 344. In this case, both the cartons 332 of the lowermost tiers and the rigid corrugated sheet 254 act as the means for controlling pillowing of the chamber and air applied in the same manner as FIG. 5 fills chamber 344 and escapes through the perforations as evidenced by arrows 352 to create the thin air film maintaining the frictionless support of the load L'' relative to the underlying fixed support surface 348. Instead of the heat shrunk band 340, the complete sheet other than the center perforated portion 346 may be heat shrunk, this embodiment having application to the packaging field wherein a carton such as 332 is required to be sealed in a plastic sheath. Alternatively, a mechanical band may be employed wrapped about the sidewalls to physically band the protruding edges of sheet 334 about the sidewalls of the carton to form plenum chamber 344. Perforations 336 may be applied to the film prior to heat shrinking or subsequent thereto and the flexible thin sheet 332 may have an integral valved inlet connection (not shown) in the manner of the embodiment of FIG. 5. A spout 360 may terminate in an elastic ring which may be stretched to permit the insertion of the discharge end of a wand 362, similar to wand 244 of the embodiment of FIG. 5, to permit pressurization of plenum chamber.

Turning to FIG. 8, there is illustrated the material handling system in operation incorporating the air pallet 630 and the clamp 642 as essential elements thereof. In this respect, a plurality of boxes or containers identified again as individual loads L are stored in side by side fashion and in a series of rows on individual air pallets 630 having right angle edge extensions 662 and 664 extending outwardly beneath the loads, the loads being essentially the same size as the air bearing surface of the pallets. In this respect, the edge 662 of the air pallet 630 at the upper right hand corner of the array within the first row, has an air clamp 642 coupled thereto in the manner illustrated in FIGS. 9, 10 and 11 (in modified form), and in which case the clamp has extending upwardly therefrom a rigid handle 610 which the operator O readily grasps. Paired air tubes 686 and 688 extend from the clamp 642 to a multiple position valve (not shown) associated with handle 610 at the top of the same and in position for ready adjustment by the operator O. Coupled to the operator's back is a pack 612 which incorporates and air blower (not shown) powered by a battery or the like. Pressurized air is delivered through inlet conduit 600 to the multiple position valve and thence to the air clamp 686, 688. In the use of the material handling system of the present invention, as illustrated in FIG. 8, air selectively applied to the lower plenum chamber associated with the improved planar air pallet 630 to create an air bearing between the bottom surface of the pallet and the floor upon which the containers L are stacked. In this case, the operator O by pulling on handle 610 moves a given air pallet 630 to which the clamp 642 is coupled and load L in the direction of arrow 644 without frictional restraint, thus allowing a relatively large load L to be moved horizontally to a position remote from that of the other containers. For instance, with a relatively small power pack, the operator O can move loads in excess of several tons by means of the simple single flexible sheet air pallet of the present invention. A one ton load can be supported adequately and moved in terms of approximately one-tenth of a horsepower by the operator. As such, approximately 27 cubic feet of air per minute will move a one ton load which constitutes a highly economical material handling system. The horsepower requirement creates the frictionless air bearing and the one ton dead weight of the load L is moved by the operator exerting his own pulling force on the handle 610, the air pallet 630 and the supported load L.

It is readily seen that with the improved air pallet 630, it makes no difference whether the pallet is upside down or not, since essentially the same valving system is employed, and the upper and lower plenum chambers may be selectively pressurized or alternatively both may be pressurized to easily slip the air pallet from beneath the load regardless of encountering surface irregularities or in fact voids within a given support surface. The air pallet first jacks the load, then reaches by means of the pillowing control features, a position of given height with the air film being maintained at a particular thickness or height corresponding again to the volume of air which is escaping, the air pressure within the chamber and the weight of the load as well as the surface area supporting the same. The perforations closest to the periphery of the planar air pallet are exposed, that is, lifted away from the support surface, as an element of pillowing control additional thereto, the fact that the pillow exists permits the pallet to move over a snag or other surface irregularity. For instance, if there were a pencil on the floor, instead of dragging it along as the perforations got there, they would tend to act in performing a local bearing function with respect to the surface of the pencil and simply ride over it, with the pencil acting as a localized air bearing. The height of the pillow controls the ability of the air pallet to ride over the surface irregularity, and obviously an irregularity in excess to the pillow control height, would act as a total obstruction to the device.

The thin flexible sheet may be in addition, flexible and resilient, that is, stretchable and retractable which property would also act as an additional means for controlling pillowing of the sheet portion of the plenum chamber in each case.

It is readily seen that with the improved air pallet 630, it makes no difference whether the pallet is upside down or not, since essentially the same air inlet and valving system is employed, and the upper and lower plenum chambers may be selectively pressurized or simultaneously pressurized to easily slip the air pallet from beneath the load. Regardless of encountering surface irregularities or in fact voids, within a given support surface, the small diameter perforations over a large surface area, automatically insures spreading of the air film over the maximum surface area once the load is jacked and the pillow height obtained. Since the planar air pallet is subjected to such little frictional restraint, there is little wear on the pallet itself and it takes up minimum space, is relatively light weight when compared to conventional wooden pallets. The operator O in FIG. 8 may well be the driver of the truck, eliminating the necessity for an additional helper in a tractor trailer transport system. A portable vacuum cleaner blower operating on batteries may form the main elements of power pack 612. By means of the portable air clamp 642, operator O may plug the clamp 642 to one extended edge 662 or at 664 of the air pallet 630 pick up the load within the tractor trailer, and move it to the customer's platform or vice versa, and then pressurize both the upper and lower plenum chambers or the upper and pull the air pallet from beneath the load. Alternatively, the operator may mechanically unclamp the air pallet leaving it beneath the load similar to a conventional palletized load material handling system, and then the customer through his own manual or vehicle mounted air source and clamp subsequently pick up the load and move it elsewhere as desired by coupling his source directly to one of the extended edges 662 or 664 of the air pallet. Extended edges with valve openings about all four sides permits access to the load from any direction, which doubles the versatility of the air pallet over conventional wooden pallets which permit the use of forks from a fork truck, for instance, to enter only from the opposite side thereof in a most simplified arrangement, could have only a given right side up, and in which case only the bottom thereof would be provided with the plenum chamber and perforated portion.

With reference to the embodiment of FIG. 1, instead of having the forks carrying air passages as at 60 and 62, the fork truck 10 could be modified such that an extendable and retractable air clamp similar to clamp 642 of FIG. 8 could be provided and in which case similar control mechanism and similar source of compressed air by compressor and tank 72 could be provided. In addition, the air clamp could be operated by pneumatic or hydraulic motor under control of the driver or operator of the fork lift truck.

Figures 9, 10:
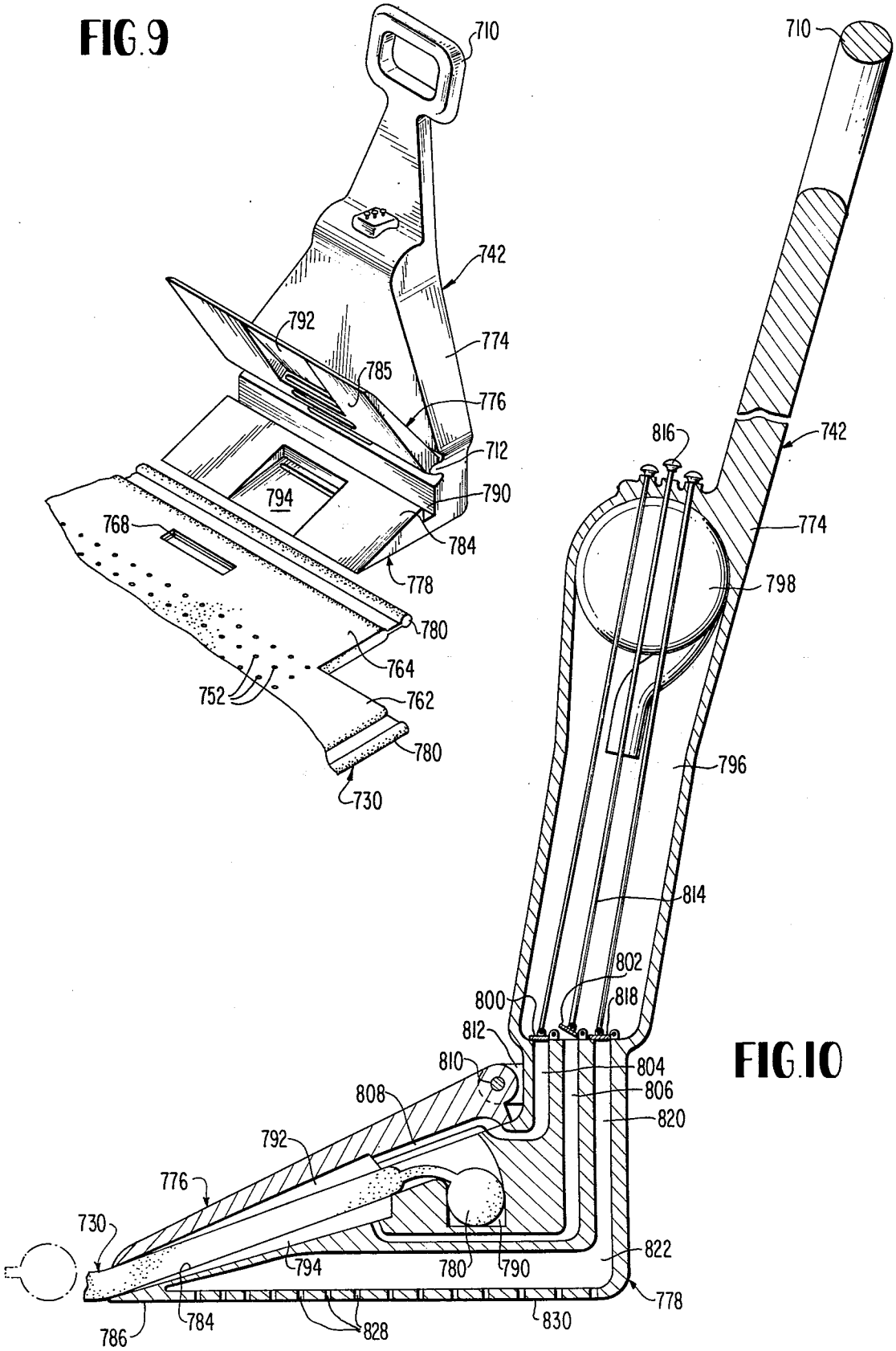
FIG. 9 is a perspective, exploded view of a modified air pallet and air clamp forming yet another embodiment of the material handling system of the present invention.
FIG. 10 is a sectional, elevational view of the air clamp of FIG. 9 coupled to one edge of the air pallet of FIG. 9.

FIGS. 9, 10 and 11 illustrate an alternate embodiment of the material handling system of the present invention comprising, essentially, a modified air pallet and a manually operated air clamp. In this respect, the air pallet 730 is selectively supplied air by means of air clamp 742 for the selective creation of air films or air bearings of superatmospheric air adjacent the upper and lower surfaces of the planar air pallet and generally over the full extent of the same in the same manner as the prior embodiments. In this case, the planar air pallet 730 comprises a rigid or flexible center sheet 736 of rectangular configuration to which is edge sealed on each side thereof, in turn, outer sheets 738 and 740, which carry small diameter perforations at 752 in patterned fashion in similar manner to the embodiment of FIG. 3. There is thus formed an upper plenum chamber 754 and a lower plenum chamber 756. The sheets 736, 738 and 740 may be formed of plastic, rubber, fabric or other thin flexible material or a combination of the same as desired. Two or more right angle edges are extended as at 762 and 764, these edge extensions being provided with various fluid passages such as 766 and 770 leading to respective chambers 756 and 754 controlled by flexible flap valves 771. Passage 766 terminates in an opening 769 on the lower surface of edge extension 264, while passage 770 terminates in a rectangular opening 768 of similar configuration to opening 769 but opening onto the upper surface of the same edge extension and laterally displaced therefrom. In addition, each of the edge extensions 764 and 762 are provided with a rounded bead 780 coupled to and aligned with the center sheet 736 via a thin strip portion 782 giving great flexibility to the larger thickness bead 780.

Clamp 42 in this case comprises a somewhat thicker casing 774 which carries at its lower end, a fixed bottom jaw 778 and a pivotable upper jaw 776, both being wedge shaped, in particular the lower jaw 778 being provided with an inclined upper surface 784 which, when acting in conjunction with a flat bottom surface 786, permits the fixed jaw 778 to slide beneath a selected edge such as edge 764 of the air pallet 730. Contact is made between the inclined upper edge 784 of the fixed jaw and the rounded bead 780, the bead readily flexing about the reduced thickness section 782. The bead 780 rides up and over the inclined surface 784 to fall into a longitudinally extending rectangular slot 790 as best seen in FIG. 10, placing rectangular openings 768 and 769 in aligned position relative to recesses or cavities 792 and 794 within respective faces 785, 784 of jaws 776 and 778. The casing 774 is provided with a manifold or air chamber 796 which is supplied with pressurized superatmospheric air from a conventional low pressure air blower 798, powered by a battery (not shown) which may be carried either by the clamp 742, or by means of a power pack (not shown) on the back of the operator similar to powered pack 612 of the embodiment of FIG. 8 with suitable circuit connections extending therebetween. Pressurized air is selectively delivered from the manifold 796 to the upper or lower chambers 754 and 756 of the air pallet 730 under the control of manually operated flap valves 800 and 802 leading to air passages 804 and 806 respectively within the lower fixed jaw 778. A fluid passage 808 is formed within the upper pivotal jaw and cooperates with passage 804 within fixed lower jaw 778 for delivering fluid to cavity or recess 792 within the lower face of pivotable jaw 776. Jaw 776 is mounted for pivoting about a horizontal axis by pivot pin 810 emanating from support brackets 812 at each end of the air clamp 742. The pivotable jaw 776 may be pivoted to closed position and held in closed position by either spring means (not shown) or positive locking means (not shown), it being essential that the jaws 776 and 778 clamp the edge extension 762, 764 therebetween in a sealed manner such that the air is directed selectively to either chambers 754 and 756 but does not escape at the interface between the jaws and the respective sides of the planar air pallet. In the sectional view of FIG. 11, pivotable flap valve 802 is shown in open position, the valve, having an operating rod 814 pivotably coupled thereto and extending upwardly and projecting from the casing 774, terminating in a knob 816 permitting manual closing of flap valve 802. There are three flap valves 800, 806, 818 controlling pressurized air flow from the chamber 796, each of which is operated by a rod and knob combination similar to that associated with the center flap valve 802. The valve 818, however, controls the creation of an air bearing between the bottom surface 786 of the fixed jaw 778 and a support surface (not shown) upon which the air pallet 730 and a load (not shown) rests. In this respect, the flap valve 818 permits air to pass through passage 820 to a chamber 822 overlying the perforated bottom surface 786 of the lower jaw 778, with leakage air flow defining a fluid or air bearing between the lower jaw and the fixed support surface.

In the operation of this embodiment, energization of blower 798 creates superatmospheric air pressure within chamber 796, the operator grasps handle 710 of the air clamp 742 and pushes the air clamp across the surface of the floor or the like toward a projected edge such as 764 of the planar air pallet 730. During this time, preferably the flap valve 818 is raised by pulling on the knob associated with its control valve, thus permitting an air cushion or air bearing to be created between the perforated bottom surface 786 of the lower jaw 778 of the air clamp and the imperforate surface across which the air clamp is traversing. Upon contacting the bead 780, which may readily flex to permit the inclined face 784 of the lower jaw to pass beneath the same, the edge projection 764 rides up and over the inclined surface 784 of the lower jaw, with the upper jaw 776 pivoted to the open position as illustrated in FIG. 9, whereupon, the bead 780 enters the rectangular elongated slot 790. Closure of the upper jaw 776 seals both surfaces of the projected edge 764 with the corresponding opposed surfaces of jaws 776 and 778 of the air clamp and mechanically locks the air pallet to the clamp. At this point, either additionally or exclusively, air flap valve 802 is opened by raising knob 816 and pressurized air is delivered to chamber 756 of the planar air pallet, creating an air cushion or bearing between the bottom surface of the air pallet and the planar surface which supports the same, thus permitting a load (not shown) to be moved under zero frictional restraint horizontallly from place to place. Ribs 737, projecting outwardly from both sides of sheet 736 insure air flow into chambers 754 and 756. When removing the air pallet from beneath the load, all three valves 800, 802 and 818 may be open, pressurizing the bottom jaw 778 and both sides of the air pallet 730 permitting the pallet to be removed from beneath the load in the manner identical to the embodiment of FIGS. 2–5 inclusive.

In the multiple embodiments described above, it is important to note that whether the single or multiple flexible thin sheets take the form of a true air bag as in the embodiment of FIG. 4, in each case the air pallet is characterized by at least one flexible thin sheet whose hole size and configuration is important to the pallet as is the strength, flexibility and size in relation to load lift center, and the air pallet may comprise a single or multiple chambers. In terms of air entry and pressurization of the plenum chamber or chambers of the air pallet, the air inlet may comprise the open end of a bag such as in the embodiment of FIG. 4, special coupling means such as spout and an insertable discharge tube or wand may be employed as shown in FIG. 5, or the forks of FIG. 1 may be inserted into special valved openings as at 32 or 34 or in fact puncture the sidewall of the bag to permit fluidization of the bag interior.

Air dispersion must occur under load. The load itself may include air dispersion means on the surface in contact with the bottom of the flexible thin sheet forming with the load or with an intermediate rigid planar backing surface the load support, the air dispersion means may take the form of strips normal to the passage of air as defined by the air supply means, blocks or balls, structural ribs, an open tube leading from the forward end of the bag to the rear of the bag or air passages within internal or exterior plates.

The function of the air chamber is to hold pressure and to permit the release of air under pressure through the perforations to create the air film between the flexible thin sheet and the underlying load support surface. The air chamber must be capable of lifting the load as a jack must control the air input to the chamber, and control the air out by way of the perforations. Further, means must be employed with respect to the chamber to control pillowing, which means may include a determination of proper board size as an internal member, the use of the load itself as a means for fixing spaced portions of the air bag or single flexible thin sheet defining with the load the plenum or air chamber.

By means of the present invention, in multi-embodiment form, the essence of the pallet with the exception of the air supply may take the form of a thin flexible shrink wrap of bioxially oriented film which may function to hold the load and fluid pallet in place, secure the load, protect the same from water, moisture, vermin (with the exception of perforations). The film may be partially or wholly colored for color coding. Depending upon the surface over which the load is to be transported, the degree of pillow control may be readily varied assuming that the package incorporates sufficient air dispersion means to effect jacking of the load, creation of the air bearing and permit the palletized package, once moving, to pass over minor obstructions compatible with the degree of controlled pillowing.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An air pallet for frictionless movement of a load supported thereon relative to an underlying generally planar fixed support surface, said air pallet comprising:

a rigid, generally planar backing surface for supporting said load thereon, a thin flexible sheet directly underlying said backing surface and directly overlying said load support surface, having that portion facing said generally planar fixed support surface perforated, and defining with said backing surface, a plenum chamber, said perforations unrestrictedly opening directly to said plenum chamber, air dispersion means within said chamber to insure air flow throughout said chamber when said pallet is under load, means for controlling pillowing of said sheet portion of said chamber to jack the backing surface and said load sufficiently to permit the pallet to accommodate surface irregularities for both said load support surface and said backing surface, without ballooning, and air inlet means to said chamber for permitting air under pressure to enter said chamber for jacking said load and for discharge through said perforations to create an air film between said flexible thin sheet and said fixed support surface.

2. The air pallet as claimed in claim 1, further comprising: a second thin flexible sheet overlying said backing surface and having the portion facing away therefrom perforated and underlying said load, such that said second thin flexible sheet and said backing surface define a second plenum chamber, said perforations within said second thin flexible sheet unrestrictedly opening directly to said second plenum chamber, and said pallet further includes air dispersion means within said second plenum chamber and means for controlling pillowing of said second thin flexible sheet and air inlet means to said second plenum chamber, whereby, pressurization of both plenum chambers permits the air pallet to be removed from between the overlying load and the underlying fixed support surface.

3. The air pallet as claimed in claim 1, said load comprising multiple tiers of stacked boxes, the bottom surface of the boxes forming said lowermost tier defining said rigid generally planar backing surface, said thin flexible sheet has edge portions extending upwardly along the sides of the boxes of the lowermost tier with their ends folded inwardly and captured between the top of the boxes of the lowermost tier and the bottom of the boxes of the uppermost tiers.

4. The air pallet as claimed in claim 3, wherein said air dispersion means comprises: a plate underlying said lowermost tier of boxes and between said boxes and said thin flexible sheet with said plate including raised surface portions on at least the side facing said thin flexible sheet.

5. The air pallet as claimed in claim 1, wherein; said load defines said rigid, generally planar backing surface, said thin flexible sheet includes peripheral edge portions extending upwardly and about the sides of said load and means are provided for sealably clamping said edge portions of said thin flexible sheet about said load.

6. The air pallet as claimed in claim 5, wherein; said air dispersion means comprises a corrugated sheet underlying said load and overlying the perforated portion of said thin flexible sheet.

7. The air pallet as claimed in claim 4, wherein; said thin flexible sheet includes at least a peripheral edge portion heat shrink to the sidewalls of said load for defining with said load, said plenum chamber.

8. The air pallet as claimed in claim 5, wherein; said thin flexible sheet includes at least a peripheral edge portion heat shrunk to the sidewalls of said load for defining with said load, said plenum chamber.

9. The air pallet as claimed in claim 1, wherein; said thin flexible sheet comprises an air bag, and a rigid member carried internally of said bag forms said rigid generally planar backing surface and said air dispersion means.

10. The air pallet as claimed in claim 1, wherein; said generally planar backing surface comprises a rigid sheet, said thin flexible sheet which underlies said backing surface has a surface area in excess of that of the rigid sheet and is heat sealed at its periphery to said rigid sheet and forms with said rigid sheet, said means for controlling pillowing of said chamber, and said air dispersion means within said chamber comprises ribs carried by said rigid sheet extending from the side of said rigid sheet facing said thin flexible sheet.

11. The air pallet as claimed in claim 10, further comprising: a second thin flexible sheet overlying said backing surface and having the portion facing away therefrom perforated and underlying said load, such that said second thin flexible sheet and said backing surface define a second plenum chamber, and said rigid sheet includes projections on the surface thereof facing said second thin flexible sheet includes projections on the surface thereof facing said second thin flexible sheet to insure air flow within said second plenum chamber, and air inlet means to said second plenum chamber, whereby, pressurization of both plenum chambers allows the air pallet to be removed from between the overlying load and the underlying fixed support surface.

12. An air pallet for frictionless movement of a load supported thereon relative to an underlying generally planar fixed support surface, said air pallet comprising:

first, second and third thin flexible sheets, the peripheral edges of said first and third sheets being heat sealed to respective sides of said second sheet at the periphery thereof and forming between said first and second sheets and said second and third sheets plenum chambers, means carried by at least one of said sheets forming air dispersion means within said chambers to insure air flow throughout said chambers, when pressurized, means for controlling pillowing of said chambers to permit the pallet to accommodate surface irregularities for both said load support surface and said backing surface without ballooning, the portions of said first and third sheets facing said load and said generally planar fixed support surface being perforated, said perforations unrestrictedly opening directly to said plenum chambers, respectively, and air inlet means for both chambers for permitting air under pressure to enter said chambers for discharge through said perforations to create an air film between said thin flexible sheets and said fixed load and fixed support surfaces, respectively.

13. The air pallet as claimed in claim 12, wherein said first and third sheets include along at least corresponding edges of the same, respectively, laterally offset integral air inlet valve flaps, said flaps projecting outwardly and being folded back on themselves and sandwiched between said first and second and second and third sheets, said respective sheets being edge sealed throughout the edges of said air pallet with the exception of those portions of the edges carrying said folded back valve flaps, whereby, said air flaps and respective sheets form said air inlet means for permitting air under pressure to enter said chamber for discharge through said perforations to create respective air films.

14. In an improved low cost low energy material handling system for moving a load relative to an underlying fixed support and comprising:

a planar air pallet supporting said load on said support, said pallet comprising an imperforate center sheet, thin flexible outer sheets edge sealed to opposite sides of said center sheet and defining therewith, upper and lower plenum chambers and carrying small diameter perforations, and means for selectively delivering superatmospheric air to said plenum chambers, the improvement wherein; said means for selectively delivering superatmospheric air to said plenum chambers comprises: an air clamp including a pair of relatively movable jaws engaging respective sides of said air pallet and being removably coupled to the edge of said air pallet, means defining a fluid manifold within said air clamp, air passage means carried by said air pallet in fluid communication with said chamber and being selectively connected to said fluid manifold, and at least one of said jaws including a transverse slot on its face facing said air pallet and said pallet including bead means received by said slot for mechanically locking said air clamp to said air pallet to prevent separation of the air clamp from said air pallet after coupling by pulling or pushing forces acting therebetween, whereby, pulling or pushing of said air clamp causes relative movement of said air pallet with respect to said load and said underlying support surface when superatmospheric air is applied to both plenum chambers.

15. The material handling system as claimed in claim 14, wherein said air clamp jaws comprise: a pair of pivotable jaws, sandwiching one edge of said air pallet therebetween, and wherein said fluid manifold is carried by at least one of said jaws with an opening within said one jaw facing one side of the air pallet and overlying one end of said passage means fluid connecting said air clamp to said plenum chambers.

16. The material handling system as claimed in claim 15, wherein said one jaw of said air clamp includes two separate fluid chambers, each of said chambers overlying an opening within said outer flexible sheet in fluid communication with a respective plenum chamber, and wherein said means for supplying superatmospheric air to said plenum chambers includes a source of compressed air, and valve means for selectively coupling said source to said chambers carried by said one clamping jaw.

17. The material handling system as claimed in claim 16, further comprising: a handle extending outwardly from said air clamp and wherein said source of compressed air comprises a portable battery powered air compressor in pack form, and flexible conduit means fluid coupling said one clamping jaw and said compressor.

18. The material handling system as claimed in claim 14, further comprising a vehicle, air supply means mounted on said vehicle and including air passage means movable relative to said vehicle at least vertically for selective coupling to said pallet; whereby, said planar air pallet may be picked up and discharged from said vehicle and pressurized thereby to permit a load carried by said pallet to be frictionlessly loaded and unloaded therefrom.

* * * * *